US007384385B2

(12) United States Patent
Dise et al.

(10) Patent No.: US 7,384,385 B2
(45) Date of Patent: Jun. 10, 2008

(54) ASSIST RESIST ABDOMINAL BENCH

(75) Inventors: David W. Dise, Richmond, VA (US); Peter W. Gowdey, Washington, DC (US)

(73) Assignee: J.E.M. Concept International, Inc. (CA)

( * ) Notice: Subject to any disclaimer, the term of this patent is extended or adjusted under 35 U.S.C. 154(b) by 0 days.

(21) Appl. No.: 11/480,530

(22) Filed: Jul. 5, 2006

(65) Prior Publication Data

US 2007/0099776 A1 May 3, 2007

Related U.S. Application Data

(60) Provisional application No. 60/730,856, filed on Oct. 28, 2005.

(51) Int. Cl.
*A63B 26/00* (2006.01)

(52) U.S. Cl. ..... 482/142; 482/140

(58) Field of Classification Search ..... 482/142, 482/92–103
See application file for complete search history.

(56) References Cited

U.S. PATENT DOCUMENTS

| | | | | |
|---|---|---|---|---|
| 6,371,896 | B1 * | 4/2002 | Kettler | 482/142 |
| 6,387,024 | B1 * | 5/2002 | Monti et al. | 482/142 |
| 6,475,127 | B1 * | 11/2002 | Koenig | 482/142 |
| 6,939,272 | B1 * | 9/2005 | Wu | 482/92 |
| 6,966,872 | B2 * | 11/2005 | Eschenbach | 482/142 |
| 6,976,944 | B1 * | 12/2005 | Damasio | 482/142 |

* cited by examiner

*Primary Examiner*—Lori Amerson
(74) *Attorney, Agent, or Firm*—Davidson Berquist Jackson & Gowdey LLP

(57) ABSTRACT

An abdominal bench having an extendable and retractable assist and resist assembly that will, depending upon how it is connected, provide variable levels of assistance forces to help pivot a torso section of the bench into an upright position and/or variable levels of forces that will resist the pivoting of the torso section. The extendable and retractable assist and resist assembly can include one or more elastic members that can work solely or in tandem to provide the assistance and resistance forces.

11 Claims, 5 Drawing Sheets

ASSIST RESIST ABDOMINAL BENCH

CROSS-REFERENCE TO CO-PENDING APPLICATIONS

The present invention is related to the following co-pending U.S. Patent applications: (1) U.S. Pat. No. 6,544,154 entitled "Variable Resistance Abdominal Bench", which issued on Apr. 8, 2003, (2) U.S. Pat. No. 6,844,203 entitled "Abdominal Bench with Constant Gap Torso Cushion", which issued on Apr. 26, 2005; (3) U.S. patent application Ser. No. 11/111,994 entitled "Abdominal Bench with Constant Gap Torso Cushion", filed on Apr. 22, 2005; and (4) U.S. Provisional Patent Application No. 60/730,856 entitled "Abdominal Bench", filed on Oct. 28, 2005, which are commonly owned at the time of filing and the entire contents of which are incorporated herein by reference.

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to variable resistance abdominal benches where user can be either assisted in using the equipment by helping a user to pivot the torso section of the bench up or can set variable amounts of resistance against which a user must pull when using the equipment.

INTRODUCTION

The present invention concerns abdominal exercise benches that includes a variety of assist and/or resist mechanisms, other than a weight, that will enable users to achieve the full benefits of abdominal work outs, and provides an abdominal exercise device that permits first time, injured or otherwise challenged or impaired users to also effectively use the equipment in incremental amounts. This latter group can be assisted in abdominal workouts, at varying amounts of assistance, yet work through the assist phases until more and more resistance is added.

Glossary: As Used Throughout This Document

The term "assist and/or resist mechanism" shall include all forms of devices and/or mechanism that can pull, push, employ compression or tension forces, including elastic devices, so that a user can establish a condition where the pivoting torso section of the bench can either be assisted in that pivoting motion or, alternatively, a condition where that pivoting motion is resisted, and provide varying levels of both assistance or resistance.

The phrase "elastic" shall mean any stretchable, elongatable, movable mechanism, as well as any elastomeric or elastic material, item, or device that can, using either pulling or pushing functions, or tension or compression forces, that will either push against the pivoting torso section of the bench and assist a user when trying to pivot the torso section from a down position into a use position, or alternatively that will provide a resistance force against which a user must pull to pivot the torso section of the bench.

DESCRIPTION OF PRESENTLY PREFERRED EXAMPLES OF THE INVENTION

Brief Description Of Figures

The invention is better understood by reading the following detailed description with reference to the accompanying drawings in which.

DESCRIPTION

The two above related patents show abdominal benches that employ a weight arranged to slide between several positions to provide either more or less weight beneath the pivoting torso portion of the bench. At one of the extreme positions the weight will actually aid or assist the equipment user and acts like a negative weight. At the opposite position the full amount of the weight must be lifted when performing a sit up.

It has been found that another approach might work as well and rather than employing a weight one can use one or more elastic members, or some other form of structure that could provide resistance in one direction yet assist or provide a negative load in another direction.

Figure 1:
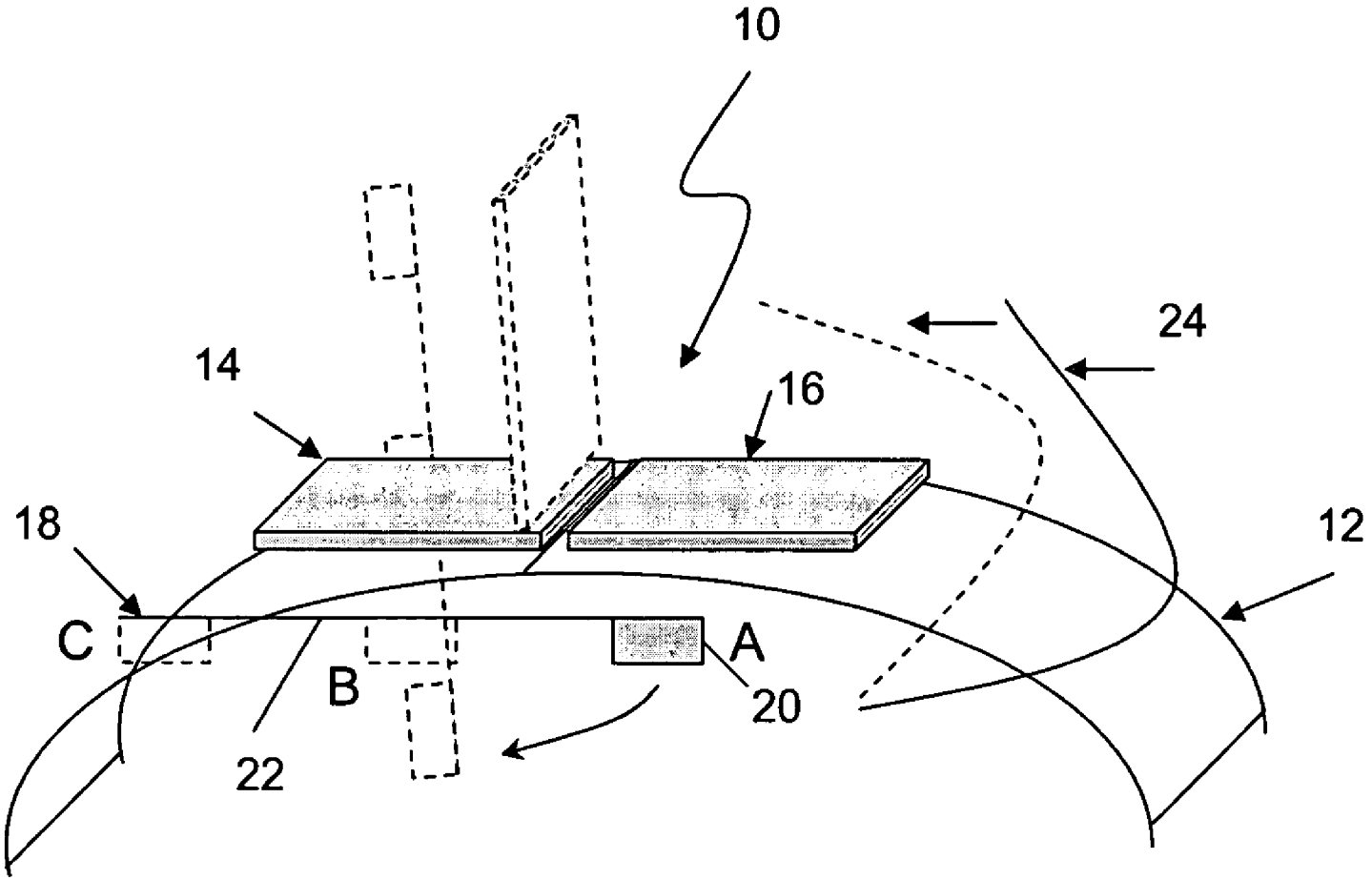
FIG. 1 is diagrammatic view of an abdominal bench showing the multiple positions thereof.

FIG. 1 is a diagrammatic and broad view of the concept of the abdominal bench in the above referenced applications, with the bench 10 being comprised of a frame 12 as torso section 14 pivotally attached to the frame 12 and movable between a lowered position, shown in full lines, and a raised position shown in dotted lines. A weight mechanism 18 is attached to the torso section 14 and a weight 20 can move along a support 22 between positions A, B, and C. A foot section is shown at 24 that can move between the full and dotted lines positions. Since the weight mechanism 18 is attached to and moves with the torso section 14 the weight mechanism 18 is also shown in full line (down) and dotted line (raised) positions. When weight 20 is in the A position the weight provides a negative weight and actually assists the user in performing sit ups. In the B position the weight 20 is in a neutral position and in the C position the weight 20 is applying its greatest resistance load to the user. Positions in between these three positions provide more or less assistance or resistance weight depending upon where the weight is located.

Figure 2:
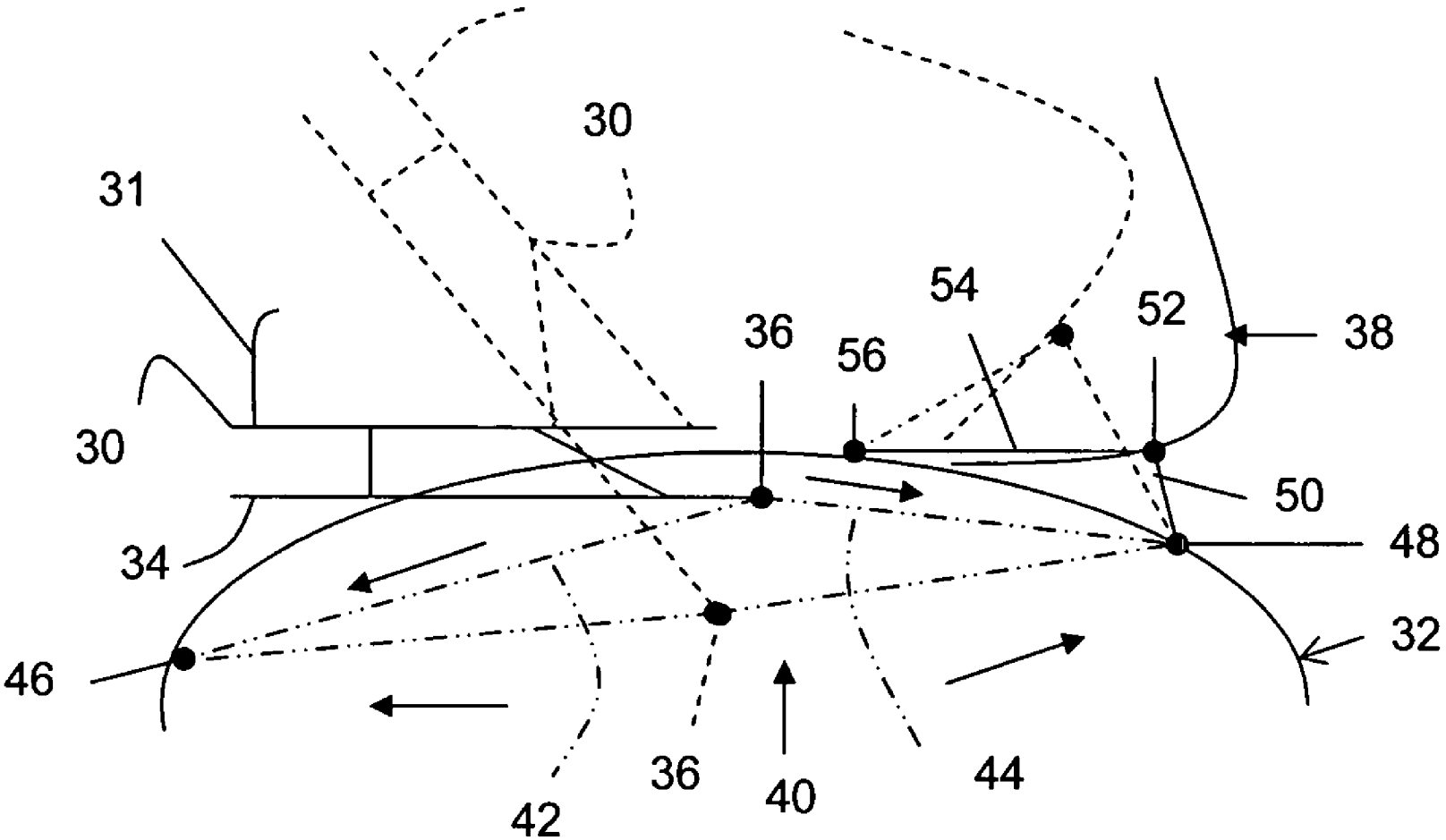
FIG. 2 is a diagrammatic view of an abdominal bench and several assist and resist options.

FIG. 2 shows a first embodiment of alternative assist and/or resist mechanisms that will provide additional abdominal exercising opportunities. The torso section, shown at 30 along with gripping arms 31, is pivotally mounted to frame 32 and will continue to be pivotal between the full line position and various positions toward a full vertical, one of which is shown by the dotted line. A foot section 38 is also pivotally attached to frame 32 and will be movable, at least between the full and dotted line positions shown. In this embodiment it is preferred to include a frame member 34 attached to the torso section 30, or at least a link structure, that will provide an interior end 36 that is connected to torso section 30 that will act as an attachment point for the assist/resist mechanism 40.

The assist/resist mechanism 40 is comprised of a first elastic member 42 one end of which is connected to end 36 of the frame member 34 and the other end is attached to the frame 32 at a point 46. A second elastic member 44 is interconnected between end 36 and frame 32 at a point 48, on the opposite side of frame 32 from point 46. Both elastic members 42 and 44 are removably attached and in most instances one of the other will be used. There can be a variety of elastic members each of which can have different degrees of elasticity, thus employing more or less resistance. When elastic member 42 is in use by it self, it will provide an assist force by pulling end 36 toward point 46 and thereby help rotate or help pivot the torso section 30 at least at the start of a crunch and thereafter depending upon the amount of force available. Depending upon the degree of elasticity chosen for elastic member 42 more or less of such an assist force can be provided.

When elastic member 44 is in use by itself, and again depending upon the degree of elasticity chosen, it will provide more or less resistance by resisting end 36 being pulled away from point 48 as a user pivots the torso section 30 toward the dotted line position.

The assist/resist mechanism 40 can also include an elastic member 50 that can be interconnected between the point 48 on the frame 32 and a point 52 on the foot section 38 so that a resist function can be provided for the foot section 50 when moved from the full line position toward the dotted line position. A second elastic member 54 can be interconnected between the point 52 on the foot section 38 and a point 56 on frame 32, so that an assist function could be provided. In each case, the amount of the resisting force or the amount of the assisting force that is available and being used can be varied depending upon the degree of elasticity chosen for the particular elastic member.

The elastic members, for example, can be comprised of any elastomeric or elastic material, item, or device, including rubber or combinations of rubber, plastic, or other elastomeric materials or combinations thereof. Such elastic members could, for example, be provided with open holes adjacent their ends which holes can allow the elastic members to be slipped over or otherwise removably connected to the points 36, 46, 48, 52 and 56, each of which could be a type of connector such as, and including but not limited to a pin, a rod or a capped rod like member, that could be welded, bolted or otherwise fixed to frame 32. Alternatively, the elastic members could be provided with a releasable or removable fastener affixed at their ends with such a fastener fitting over or being connectable to the pins or rods mentioned above. It should be understood that a variety of removable fastening techniques could be employed that would permit the elastic members to be put on and removed from the pins or connectors on the frame, and the forgoing description should not be viewed as being limited or limiting in any way The elastic members could also include springs, including both compression and tension springs, elastic straps, combinations of foam and elastic, or any stretchable material or member where the amount of stretch can be controlled or varied by the material used, by changing the size or dimensions of the material or by the combinations of materials being used. In addition, the elastic members could be flat straps, hollow tubes, sections cut from sheets of elastic material or other shapes and forms of elastic material. These would also be used with the pin or connectors on the frame.

Figure 3:
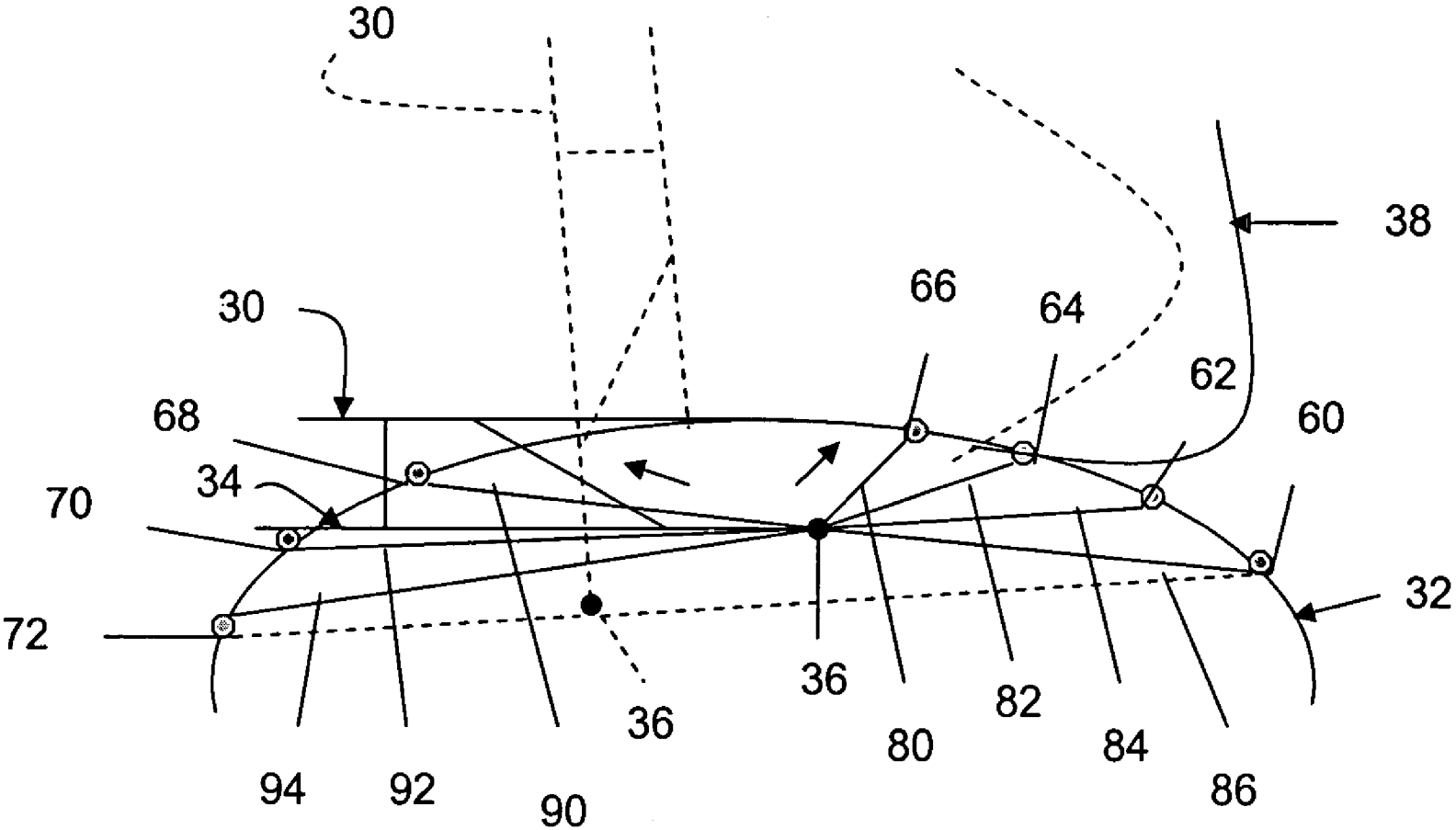
FIG. 3 shows diagrammatic view of an abdominal bench with other assist and resist options.
Figure 4:
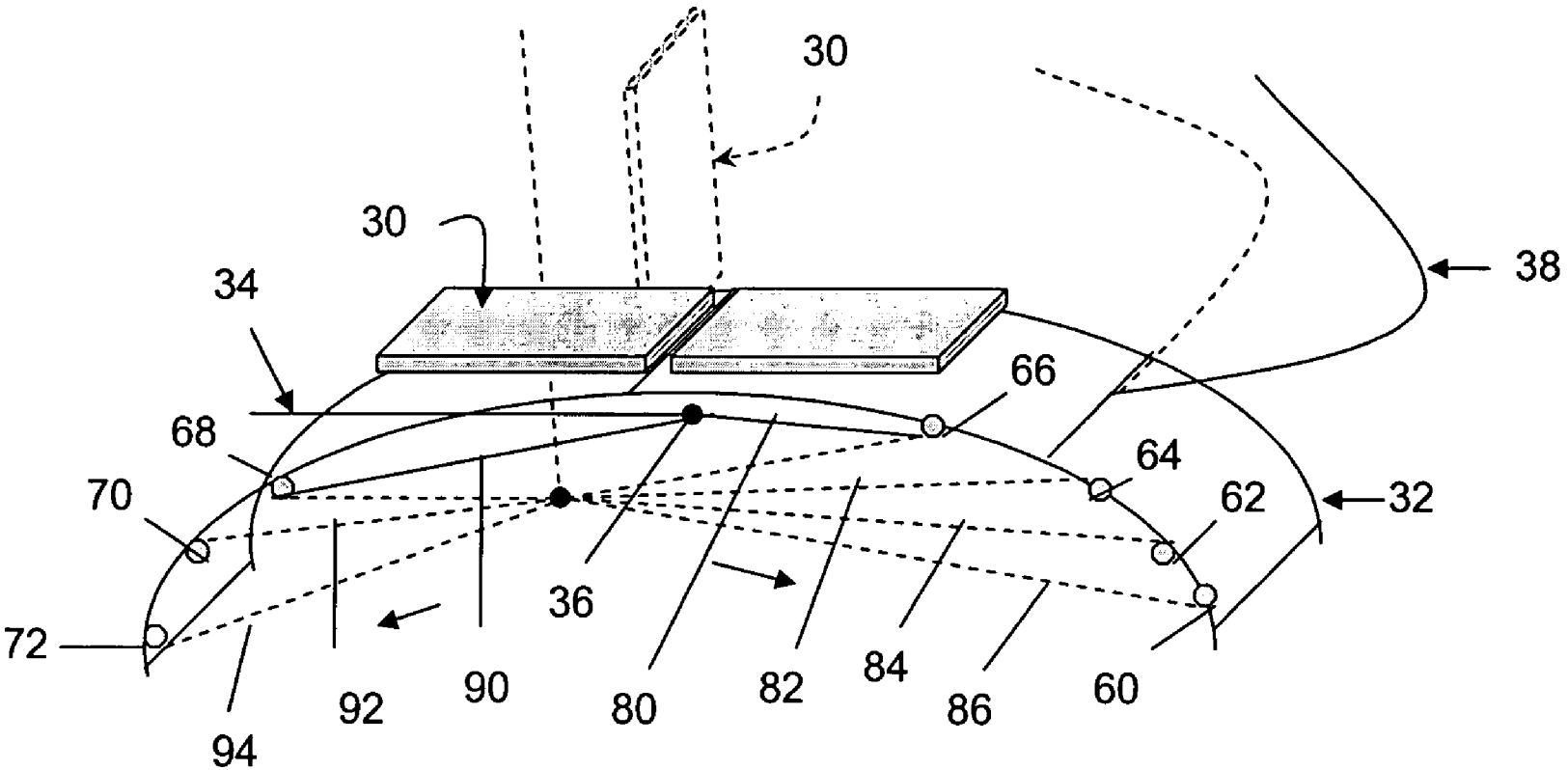
FIG. 4 is a diagrammatic view of an abdominal bench similar to FIG. 1 but with other resist options.

FIGS. 3 and 4 show another arrangement for adjusting the amount of force available for either assisting a bench user or for resisting the pivoting of the torso section 30. Here frame 32 has been supplied with a plurality of elastic member attachment points, as at 60-66 on one side for adding resistance, while points 68-72 on the other side of the frame 32 provide attachment points for adding assistance forces.

Various combinations are now possible. For example, on the resistance side one approach would be to choose one from a plurality of elastic members, for example those shown at 80-86, which could thus provide varying lengths and/or strengths and thereby vary the amount of resistance selected. Alternatively, one elastic member could be used but its point of attachment could changed between points 60-66 so that as the point of attachment changed for that given elastic member it will provide its own variations in the amount of available elasticity, more or less depending on the changing distance it must be pulled. As another alternative, two, three or all four elastic members 80-86 could be used with the latter thereby providing a maximum amount of resistance force with the arrangement shown.

On the assistance side, elastic members 90-94 will also have three points of attachment, 68-72 and thereby provide a plurality of strengths for applying a pulling force on end 36.

Figure 5:
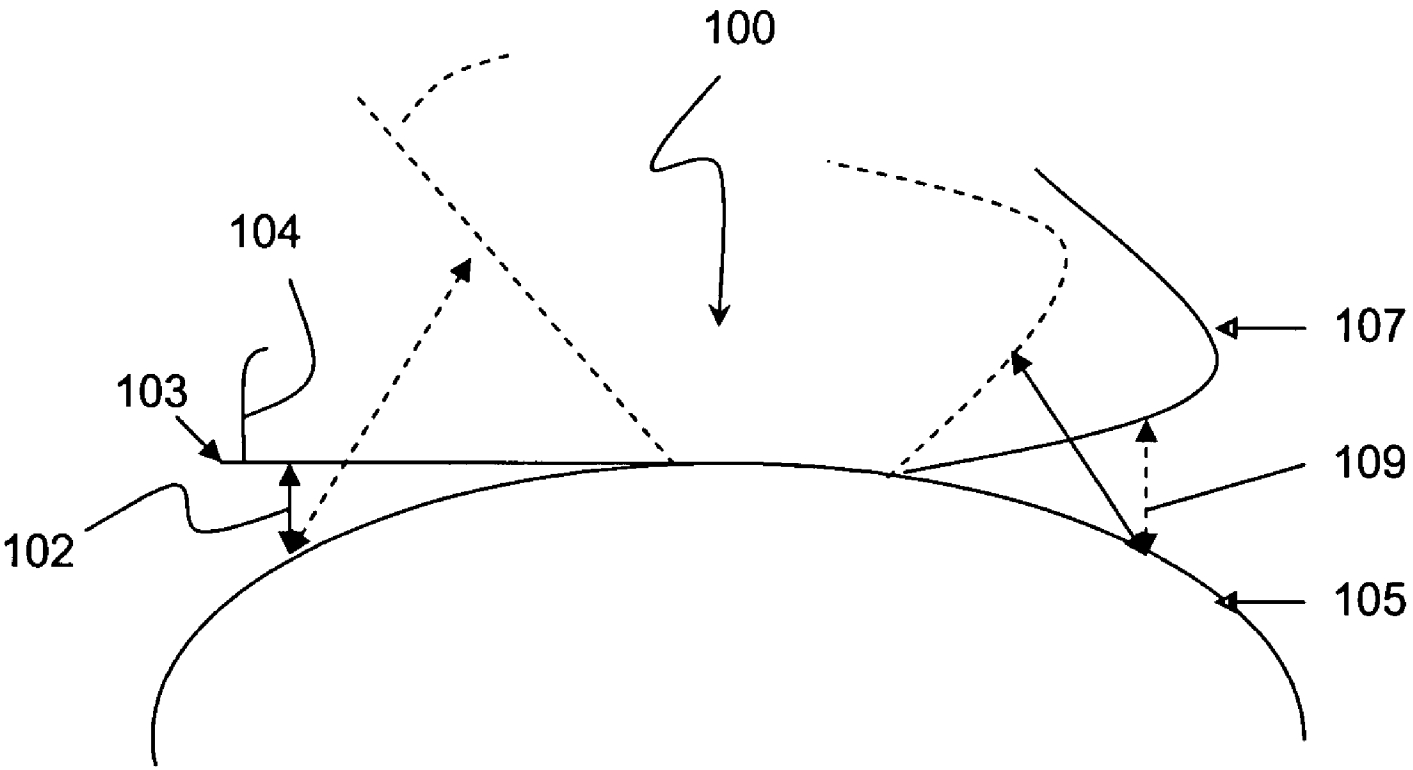
FIG. 5 another exemplary embodiment of the present invention.

FIG. 5 shows another embodiment for an abdominal bench 100 where the frame 105 supports a dual-action, pneumatic or hydraulic cylinder 102, that is pivotally interconnected between frame 105, for example on a suitable cross beam (not shown), and a connector located on the bottom surface of the torso section 103. All that is required of cylinder 102 is to be able to operate in either an assist mode to push the torso section 103 upwardly, or in a resist mode where it would resist pivoting of the torso section 103 upwardly from the down position shown. In one form, cylinder 102 could be computer controlled to provide what ever effect a user entered into a control system to produce a force in one direction or the other and the amount of force or resistance. In a simplified version, the cylinder could be operated by rotating it clockwise or counter clockwise to thereby set either an assist or resist function, the with amount of force or resistance being dependent upon the number of rotations. The bench 100 includes a foot section 107 and a pair of handles on the torso section 103 to aid in performing crunch exercises. In this embodiment as well, elastic members could be used between the frame 105 and the torso section 103 to provide resistance to pivoting the torso section upwardly. In fact, elastic members could be used in conjunction with the cylinder 102 for resistance purposes. In addition, the foot section 107 could also include a similar cylinder 109 to provide either an assist or resist function to movement of the foot section 107.

As another alternative, the torso section 103 could be provided with a spring or a series of springs working in tandem or collectively, that could provide an assist function to help raise the torso section 103. Depending on the type of spring being used they could be located in place of cylinder 102 or otherwise positioned beneath torso section 103. Leaf springs, for example, could be located horizontally below the torso section and appear in a series manner as the torso section is raised, or might provide only an initial assistance force at the beginning of movement of the torso movement. Conversely, a coil spring could be used in place of cylinder 102, but in that position, to provide resistance to the pivotal movement of the torso section 103.

In each of these embodiments, the foot section could be an independent section that could operate with but the operation of which was not linked to the torso section. Alternatively, the foot section could be interconnected to or linked to operate in conjunction with the torso section, as shown in the two above referenced '154 and '203 patents, which are commonly owned at the time of this filing and the entire contents of which is incorporated herein by reference thereto.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. An abdominal bench comprised of a frame, a torso section pivotally connected to the frame at a torso pivot point, and an extendable and retractable assist and resist assembly, interconnected between the frame and the torso section, that can be alternatively connected to provide assistance to help pivot the torso section and connected to resist the pivoting of the torso section, the extendable and retractable assist-resist assembly including a torso section assist/resist attachment point located at a point spaced from the torso pivot point and a plurality of frame assist/resist attachment points and at least one elastic assist/resist member connected between the torso section assist/resist attachment point and at least one of the frame assist/resist attachment points.

2. The abdominal bench as in claim 1 wherein the frame includes opposing ends and the plurality of frame assist/resist attachment points include frame assist/resist attachment points located along portions of the frame at a variety of spaced apart intervals away from the torso pivot point toward each of the opposing ends thereof so that as the at least one elastic assist/resist member is connected between the torso section assist/resist attachment point and different ones of the frame assist/resist attachment points the amount of assistance and resistance is variable.

3. The abdominal bench as in claim 1 further including a foot section pivotally connected to the frame at a foot section pivot point, the extendable and retractable assist-resist assembly further including a foot section assist/resist attachment point located at a point spaced from the foot section pivot point and a plurality of frame assist/resist attachment points and at least one elastic assist/resist member connected between the foot section assist/resist attachment point and at least one of the frame assist/resist attachment points to permit the forces exerted by the extendable and retractable assist and resist assembly to be varied.

4. An abdominal bench comprised of a frame, a torso section pivotally connected to the frame at a torso pivot point, and an extendable and retractable assist and resist assembly, interconnected between the frame and the torso section, that can be alternatively connected to provide assistance to help pivot the torso section and connected to resist the pivoting of the torso section, wherein the extendable and retractable assist and resist assembly comprises an elastic member.

5. The abdominal bench as in claim 4 wherein the elastic member comprises an elastomeric material.

6. The abdominal bench as in claim 4 wherein the elastic member comprises a rubber strap.

7. The abdominal bench as in claim 4 wherein the elastic member comprises a spring.

8. The abdominal bench as in claim 1 the extendable and retractable assist and resist assembly comprises a dual acting cylinder.

9. An abdominal bench comprised of a frame, a torso section pivotally connected to the frame at a torso pivot point, and an extendable and retractable assist and resist assembly, interconnected between the frame and the torso section, that can be alternatively connected to provide assistance to help pivot the torso section and connected to resist the pivoting of the torso section, wherein the extendable and retractable assist and resist assembly comprises a plurality of elastic members.

10. The abdominal bench as in claim 9 wherein one of the plurality of elastic members is used at a time.

11. The abdominal bench as in claim 9 wherein two or more of the plurality of elastic members are used simultaneously.

* * * * *